United States Patent [19]

Baughman

[11] Patent Number: 4,694,672

[45] Date of Patent: Sep. 22, 1987

[54] METHOD AND APPARATUS FOR IMPARTING A SIMPLE CONTOUR TO A WORKPIECE

[76] Inventor: Davis L. Baughman, Rte. 10, Box 105, Hagerstown, Md. 21740

[21] Appl. No.: 781,206

[22] Filed: Sep. 30, 1985

Related U.S. Application Data

[63] Continuation of Ser. No. 568,403, Jan. 5, 1984, abandoned.

[51] Int. Cl.[4] ..... B21J 5/00

[52] U.S. Cl. ..... 72/53; 51/319; 51/417

[58] Field of Search ..... 72/53, 40; 51/319, 417, 51/420, 320

[56] References Cited

U.S. PATENT DOCUMENTS

| | | | |
|---|---|---|---|
| 2,701,408 | 2/1955 | Borger | 72/53 |
| 2,881,506 | 4/1959 | Fuchs | 72/53 |
| 3,495,720 | 2/1970 | Mann, Jr. et al. | 51/419 |
| 3,521,406 | 7/1970 | Carpenter, Jr. | 51/9 |
| 3,599,460 | 8/1971 | Finkin | 72/53 |
| 3,653,239 | 4/1972 | Carpenter, Jr. | 72/53 |
| 3,668,912 | 6/1972 | Baughman et al. | 72/53 |
| 3,705,510 | 12/1972 | Baughman | 72/53 |
| 3,705,511 | 12/1972 | Brandel et al. | 72/53 |
| 4,277,965 | 7/1981 | Rutten | 72/53 |
| 4,329,862 | 5/1982 | Harburn et al. | 72/53 |
| 4,366,690 | 1/1983 | Rutten | 72/53 |

OTHER PUBLICATIONS

Davis L. Baughman, "Peen Forming", 11/12/70, pp. 156–160.

*Primary Examiner*—Lowell A. Larson
*Assistant Examiner*—David B. Jones
*Attorney, Agent, or Firm*—Wayne D. Porter, Jr.

[57] ABSTRACT

An improved method and apparatus is provided for imparting a simple contour to an aircraft skin. A treatment chamber having a conveyor with a workpiece attached thereto and a shot peening blast unit positioned therein is provided. The workpiece is conveyed past the blast unit for peening treatment. A control system is provided for orienting the workpiece and blast unit so that the peening is done only in narrow spanwise strips and only on common chord percentage lines of the workpiece. This method and apparatus thereby creates chordwise simple curvature to the workpiece while minimizing compound curvature effects.

15 Claims, 3 Drawing Figures

METHOD AND APPARATUS FOR IMPARTING A SIMPLE CONTOUR TO A WORKPIECE

The present application is a continuation of application Ser. No. 568,403, filed Jan. 5, 1984, now abandoned.

BACKGROUND OF THE INVENTION

1. Field of the Invention

This invention relates to a method and apparatus for imparting a simple contour to a workpiece and, more particularly, to a method and apparatus for shot peening a wing skin to form a simple contour which matches the chordwire curvature of an aircraft wing.

2. Description of the Prior Art

The application of simple curvatures to aircraft skins by shot peen forming is not new. It has been done with air nozzle peening for many years as exemplified by U.S. Pat. No. 2,701,408; and by centrifugal shot throwing wheels as exemplified by U.S. Pat. No. 3,705,510. However, the use of shot peening in a metal part as taught by these and other state of the art patents encourages the formation of simple and compound contours. In the typical peening process, a flat piece of metal is peened to form a predetermined shaped contour which approximates the chordwise curvature of a desired aircraft wing. Because the shot consists of spherical elements, their striking of the treated metal part causes the application of compressive stresses to the metal part along axes in all directions, thereby resulting in the curving or contouring of the part in all directions. This peen shaping is known as hemispheric shaping and is desirable for some applications. Accordingly, a compound contour is imparted to the metal skin, namely the skin develops a spanwise curvature in addition to the more desirable chordwise curvature. U.S. Pat. No. 4,329,862 is exemplary of a complicated method for utilizing and propagating compound contours throughout a flat metal sheet to more closely approximate the exact shape of an aircraft wing. However, devising a system which controls and encourages both chordwise and spanwise curvature is extremely complicated and requires extensive trial and error testing to develop appropriate banks of information which can be later programmed into a computer to control the shot peening equipment. It is, therefore, highly desirable to have a method which easily treats the workpiece and develops only chordwise curvature. In response thereto and in applications where it is necessary to inhibit or prevent compound contour formation, pre-stressing or clamping the metal part in an over-curved condition during peening can be an effective preventive method. Further, some metal parts are provided with longitudinal stiffeners which discourage compound curvature by supplying increased strength to the metal part for withstanding the multi-directional compressive forces of the peening process. Additionally, after compound contours have been formed in the peened metal part, subsequent touch-up peening can also be utilized. Touch up peening is substantially a trial-and-error method employed to correct localized compound contouring by peening various locations on the part in an attempt to reverse some of the undesirable growth and compound curvature which had been previously imparted thereto as described above. Unfortunately, such methods of correction are cumbersome and time consuming and extremely expensive, especially when the costs of the additional touch up peening are included.

SUMMARY OF THE INVENTION

The present inventive method and apparatus overcomes the aforementioned problems and effectively minimizes the formation of compound contours in metal having no integral longitudinal stiffeners and further minimizes the amount of touch-up peening which may subsequently be required.

Accordingly, it is a primary objective of the present invention to provide a new method and apparatus for imparting a simple contour to a workpiece and to simultaneously minimize the formation of compound contouring therein.

In accordance with an aspect of the present invention, an improved method for imparting a simple contour to a workpiece is disclosed and includes passing a flat sheet of metal through shot peening equipment, with the equipment shot peening the metal only on one side thereof with the peening being of variable predetermined intensity and specifically applied spanwise to, and in the direction of, the movement of the metal sheet. After completing the application of a single strip of peening to the metal, the orientation of the shot peening equipment and the metal sheet are modified in such a manner as to allow subsequent shot peening to be done in narrow spanwise strips applied in the direction of movement of the workpiece along chord percentage lines of the metal part.

The apparatus of the present invention provides a treatment chamber which has a conveyor means for moving a workpiece therethrough. The conveyor means has a transport means and a rail means. A workpiece affixing means is also provided thereon and includes adjusting means for positioning the workpiece relative to the rail means. One or more shot throwing means further provided in the treatment chamber and is movable and rotatable about an axis and is positioned to one side of the workpiece. Finally, a control system is employed and is electrically connected to the shot throwing means to regulate the flow and direction of the discharged shot and is further connected to the adjusting means to direct and position the workpiece in order to receive the discharged shot in spanwise extending strips.

BRIEF DESCRIPTION OF THE DRAWINGS

The foregoing and other objects, advantages and characterizing features of the present invention will become clearly apparent from the ensuing detailed description of an illustrative embodiment thereof, taken together with the accompanying drawings wherein like reference numerals denote like parts throughout the various views and in which.

DETAILED DESCRIPTION OF THE PREFERRED EMBODIMENTS

Figure 1:
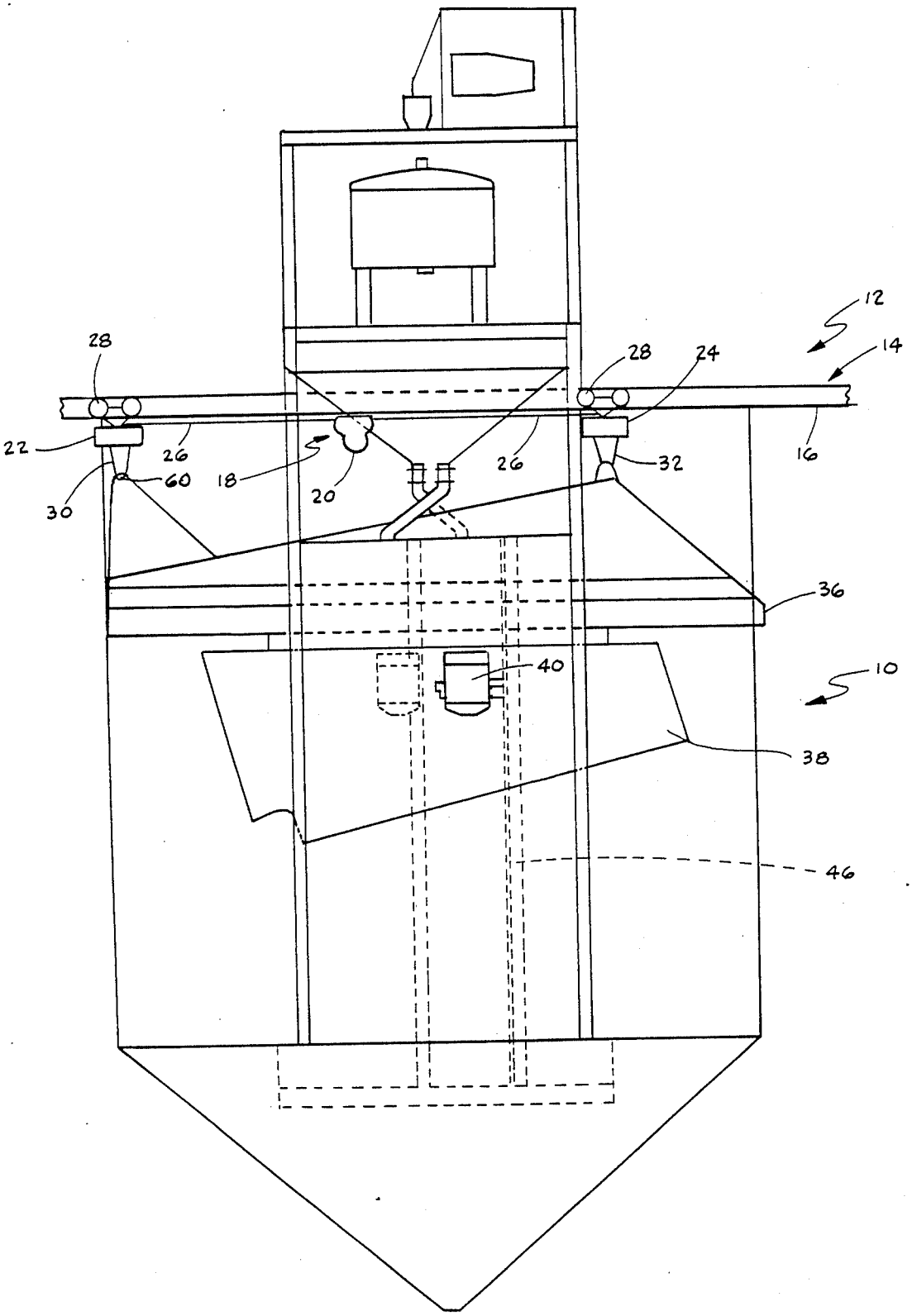
FIG. 1 is a side elevational view of the shot peening apparatus according to the teachings of the present invention.
Figure 2:
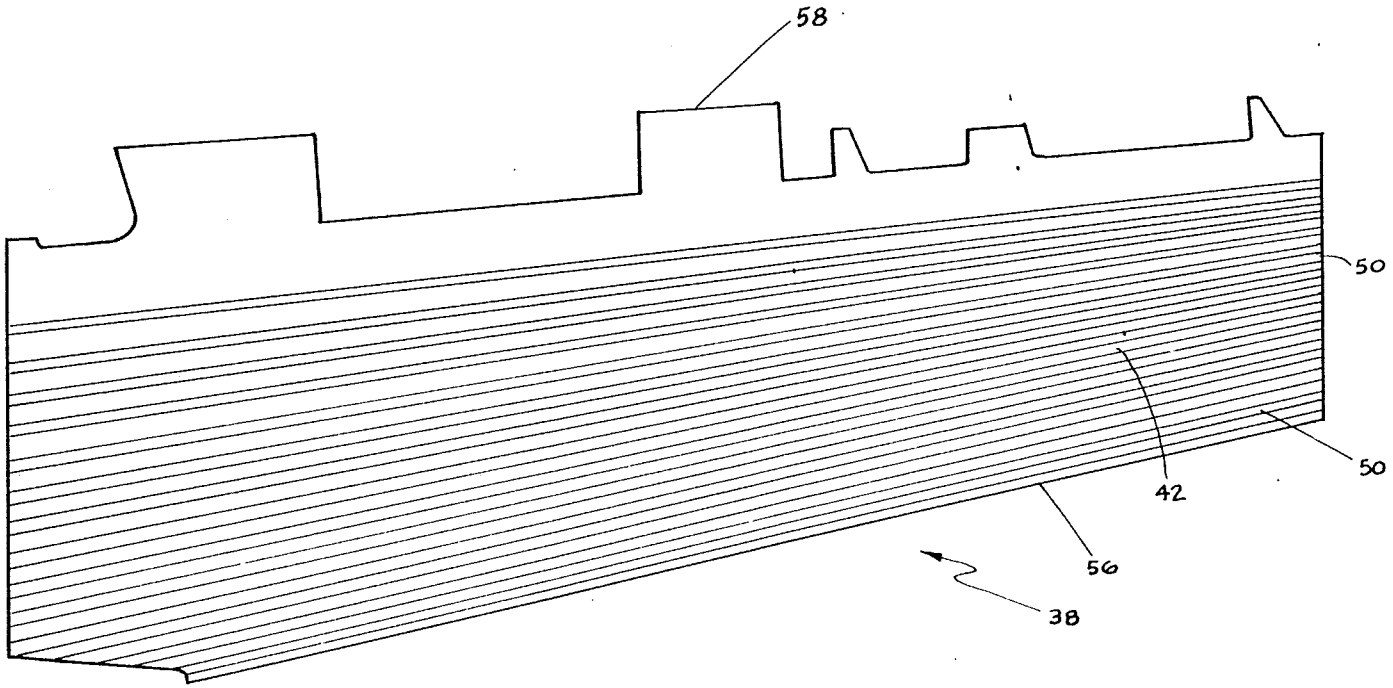
FIG. 2 is a perspective view of a flat piece of metal showing an array of spanwise narrow strips of where the shot peening is typically applied.
Figure 3:
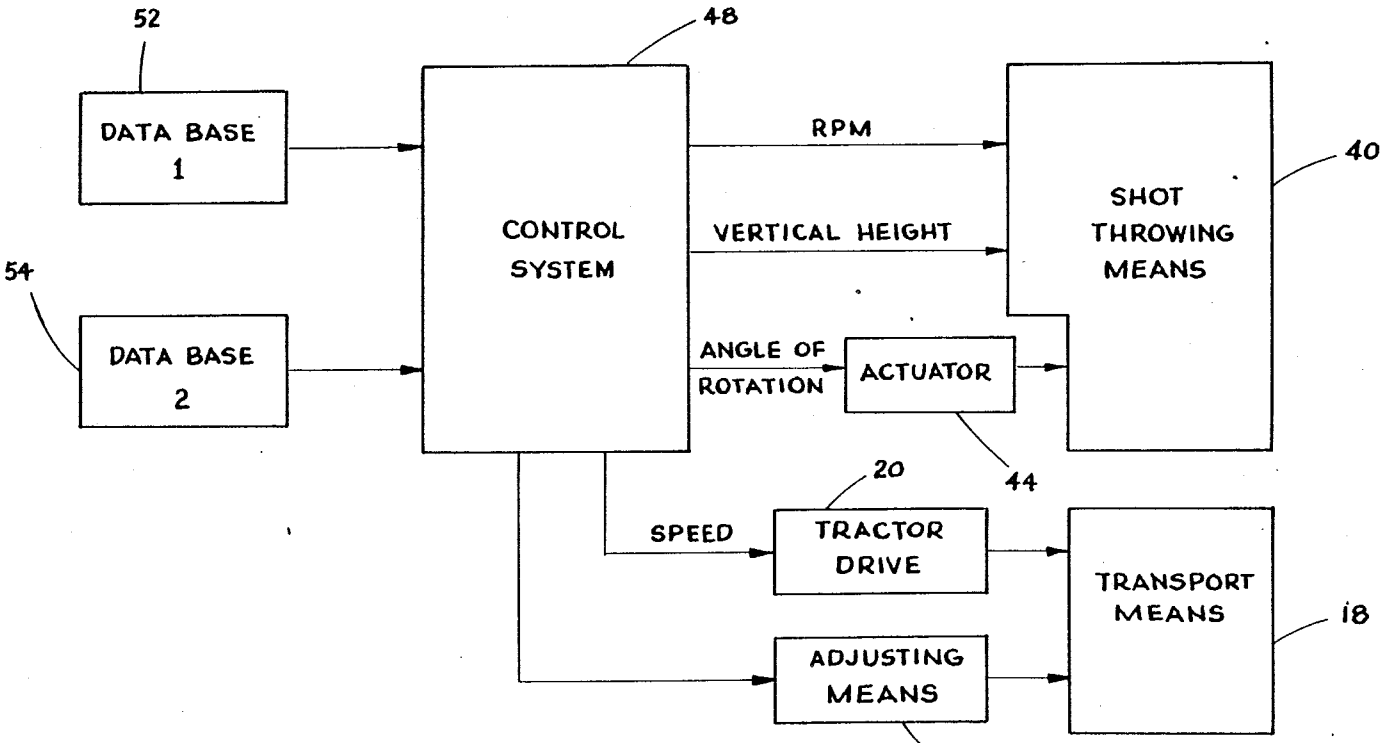
FIG. 3 is a schematic of the regulating process utilized by the control system.

Referring now in detail to FIGS. 1 through 3, there is disclosed a novel method and apparatus according to the teachings of the present invention having a treatment chamber 10 with a conveyor means 12, or monorail system, extending therethrough. The conveyor means 12 includes a rail means 14 which includes rails 16 extending outwardly from the treatment chamber 10 and supported by any well known support structure (not shown). A transport means 18, which typically includes a tractor 20, provides movement along the rail means 14. A first hoist 22 and a second hoist 24 are rigidly connected via tie bars 26 to the tractor 20 and are each provided with wheels 28 which ride along rail means 14 and further enable ease of movement of the transport means 18 along the conveyor means 12. The first hoist 22 is preferably at least one ton electric chain hoist having a one horsepower motor for the lowering or raising of a chain 30 extending therefrom. The adjusting means, or second hoist 24 is also preferably a one ton electric chain hoist having a one horsepower motor for the lowering or raising of chain 32 which can be programmed to lengthen or shorten the chain 32 to any length thereby pivoting lead beam 36 about pivot point 60. The preferred maximum programmed length for the chain 32 is approximately three feet, but other longer lengths can easily be used with the present invention and are therefore believed to be within the scope of the present invention.

A load beam 36 is provided and is attached to the chains 30, 32 in a manner well known in the art. A flat sheet of metal, or workpiece 38, which is to be treated to become a wing skin, is attached to the underside of the load beam 36 in such a manner by any rigid means as is well known in the art as to be suspended from the rail means 14 via the adjusting means which includes hoists 22, 24, chains 30, 32 and load beam 36. Upon activation of the tractor 20, this entire assembly can be easily transported through treatment chamber 10.

A shot throwing means 40, or blast unit, which is a centrifugal shot throwing wheel, is further provided at a predetermined spaced relationship to the workpiece 38 within treatment chamber 10. In order to carry out the present method and apparatus, a single blast wheel 40 is provided to discharge shot at one side 42 of the flat sheet of metal 38. Side 42, after treatment, will become the convex side of the wing. However, in a preferred embodiment of the present apparatus, an oppositely disposed blast unit (see FIG. 1) is also provided and is utilized in the event that subsequent touch up peening is required. It is important to note that the actual details of the internal workings of the blast units are well known and beyond the scope of the present invention. Shot feeding means and supply apparatus (not shown), including supporting structure, are also provided to supply and receive shot to and from the blast as is also well known in the art. A parameter of importance to the shot throwing means 40, however, is that the shot pattern of discharge must be extremely narrow and is typically a function of the width, curvature, thickness and surface roughness of the metal sheet. The shot throwing means 40 is further provided with an actuator 44 which can be hydraulic or electric and, when activated, causes the shot throwing means 40 to be rotated through a range of predetermined angles about an axis. A vertical support means 46 which supports and allows vertical movement of the shot throwing means 40 is also positioned within treatment chamber 10.

As is more clearly shown in FIG. 3, a programmable control system 48 is provided and is informationally and electronically connected to the transport means 18, the adjusting means 24 and the shot throwing means 40. It is of prime importance to the present invention that in order to maximize the amount of simple contour formation and simultaneously minimize compound contour formation, the discharged shot must be applied to the workpiece 38 in narrow, spanwise strips 50 (see FIG. 2), with the shot throwing means 40 aligned to apply the shot along the direction of movement and the common chord percentage lines of the workpiece 38. Accordingly, the orientation of the discharged shot relative to the workpiece 38 must be highly controlled and regulated by control system 48. More particularly, the adjusting means 24 must operate in synchronization with the shot throwing means 40 in order to allow strips 50 to be formed along predetermined spanwise locations. In order to program the apparatus, via the control system 48, two data bases 52, 54 are generated and fed into the control system 48. Data base 52 consists of the positions of the common chord percentage lines of the workpiece 38. The chord distance is defined as the distance between the leading edge 56 and the trailing edge 58 of the workpiece 38. The values for the common chord percentage lines are defined as the constant percentage of chord distances calculated over the span of the wing. These values, hence, are based on the length of workpiece 38 and the varying chord distances and are easily calculatable values. Data base 54 is generated by measuring the overall dimensions and thickness of the workpiece 38 along its span.

The control system 48 uses the values generated in the data bases 52, 54 to synchronize and control various elements in the treatment chamber 10. The speed of the workpiece 38 is controlled by electronically connecting the tractor 20 thereto. The intensity of the discharged shot is controlled by varying the revolutions per minute of the wheel contained within the shot throwing means 40. The intensity is varied to compensate for the varying thickness and the desired contour of the workpiece 38. The control system 48 utilizes the adjusting means 24 which can raise and/or lower chain 32 and can also either move or rotate the shot throwing means 40 by engaging the vertical support means 46, or the hydraulic actuator 44. Typically, after a particular strip 50 has been shot peened, the control system 48 can then orient the different elements to allow spanwise peening along any given strip 50 on workpiece 38. In this manner, selective portions or entire strips 50 can be treated as desired or programmed. At the present time, it is generally believed that the best results in propagating simple contours occur by shot peening the center of the workpiece 38 and working the method outwardly toward the leading edge 56 and trailing edge 58.

In operation, a workpiece 38 is attached to the load beam 36 and the tractor 20 is activated to transport the workpiece 38 into treatment chamber 10. Data bases 52, 54 have previously been generated by calculating the percentage chord lines and measuring the overall dimensions, including the thickness, of the workpiece 38. The programmable control system 48 is engaged and simultaneously regulates the speed of the tractor 20, the angular and vertical position of the shot throwing means 40, as well as the intensity of the shot to be discharged therefrom. The tractor 20 moves the affixing means and transport means 18 along conveyor means 12 with the workpiece 38 suspended therebelow. The control system 18 longitudinally orients the shot throwing means 40 so that the shot is discharged in a narrow spanwise strip 50 along the direction of travel and on the common chord percentage lines of workpiece 38. After treatment of a strip 50 has been completed, the control system 48 utilizes the adjusting means 24 to either raise or lower chain 32. The angular and vertical orientation of the blast unit 40 is likewise adjusted with the workpiece 38 again passing the blast unit 40, thereby allowing treatment of a second narrow strip 50 on the surface of the workpiece 38. The particular adjustments of the adjusting means 24 and blast unit 40 are dependent upon the location of the second and subsequent strips 50 on the workpiece 38.

In summary of the overall operation of the present invention, a flat sheet of metal, or workpiece 38, is passed through shot peening equipment, with shot peening occurring on a single side thereof and with the peening occurring with variably controlled intensity in the direction of movement of the workpiece 38. The positioning of workpiece 38 is regulated by a control system 46 which monitors the spatial relationship between workpiece 38 and shot throwing means 40 assuring that the peening occurs in narrow spanwise strips 50 along common chord percentage lines.

From the foregoing, it is apparent that the objects of the present invention have been fully accomplished. As a result of the present invention, a new and improved method and apparatus for imparting a simple contour to a workpiece has been disclosed. A preferred embodiment of the principles of this invention having been described and illustrated, it is to be realized that the same are not limited to the particular method and apparatus shown in the drawings, and that modifications thereof are contemplated and can be made without departing from the spirit and scope of this invention as defined in the appended claims.

What is claimed is:

1. Apparatus for imparting a simple contour to a flat workpiece so as to form a wing skin, comprising:

a treatment chamber;

a conveying means extending through said chamber for moving the workpiece through the chamber, the conveying means including a rail means, a transport means, and a workpiece affixing means having an adjusting means for positioning said workpiece in relation to the rail means;

a shot throwing means carried by the treatment chamber capable of discharging shot in a pattern into the treatment chamber and onto a selected side of the workpiece; and a control system for the shot throwing means to regulate the flow and direction of the shot discharged therefrom, the control system further connected to the adjusting means to direct and position the workpiece to receive.the discharge pattern of shot on the selected side in spaced narrow spanwise strips.

2. The apparatus of claim 1, wherein the adjusting means comprises a first and second hoist means which include first and second chain means, respectively, and which are alternatively attached to said transport means and a load beam, said load beam being attached to said workpiece.

3. The apparatus of claim 2, the adjusting means further including a second hoist means which includes a chain means and an encoder operatively connected to the control system.

4. The apparatus of claim 1, the shot throwing means further including an actuator operatively connected to the control system for controlling the intensity of shot discharged from the shot throwing means.

5. The apparatus of claim 1, wherein the shot throwing means includes a plurality of blast units each including a centrifugal blast shot peening wheel.

6. The apparatus of claim 5, wherein the control system is operatively connected to the shot throwing means to regulate the intensity of the shot disclosed therefrom by controlling the speed of the shot peening wheel.

7. The apparatus of claim 1, the control system including a programmable system which utilizes data bases.

8. The apparatus of claim 1, the shot throwing means being movable in a direction perpendicular to the direction of movement of the workpiece.

9. A method of forming a simple-contour wing skin from an elongate, flat sheet of metal, the sheet of metal having a longer dimension defining the span of the wing skin and a shorter dimension defining the chord of the wing skin, the longer opposed edges of the sheet of metal defining the leading and trailing edges of the wing skin, comprising the steps of:

disposing the sheet of metal adjacent shot peening equipment;

moving the sheet of metal relative to the shot peening equipment in the spanwise direction of the wing skin; and shot peening the sheet of metal on one side, the shot peening being applied in spaced, narrow spanwise strips.

10. The method of claim 9, wherein the step of disposing includes orienting the sheet of metal with the leading and trailing edges generally horizontal and suspending the sheet of metal from either the leading edge or the trailing edge.

11. The method of claim 10, wherein one of the suspension points is at one end of the wing skin and the other suspension points are raised or lowered so as to pivot the wing skin about the first suspension point.

12. The method of claim 9, wherein the intensity of the peening is varied to compensate for any thickness variations in the sheet of metal.

13. The method of claim 9, wherein the strips are applied one at a time.

14. The method of claim 13, wherein the first strip is applied along the center chord percentage line and subsequent strips are applied along chord percentage lines disposed toward the leading and trailing edges.

15. The method of claim 9, wherein the spanwise strips are applied along chord percentage lines.

* * * * *